United States Patent [19]

Mittelmann et al.

[11] 4,422,558

[45] Dec. 27, 1983

[54] CONTAINER FOR FREIGHT TRANSPORT

[75] Inventors: Gerhard Mittelmann, Oehningen; Klaus P. Brodbeck, Singen; Gerd Bretschneider, Hilzingen, all of Fed. Rep. of Germany

[73] Assignee: Swiss Aluminium Ltd., Chippis, Switzerland

[21] Appl. No.: 275,802

[22] Filed: Jun. 22, 1981

[30] Foreign Application Priority Data

Jun. 30, 1980 [DE] Fed. Rep. of Germany ..... 3024707

[51] Int. Cl.[3] ..... B65D 8/10; B65D 6/36

[52] U.S. Cl. ..... 220/1.5; 52/656; 220/72; 220/84; 220/4 F

[58] Field of Search ..... 220/4 F, 1.5, 84, 71, 220/80, 76, 72; 217/12 R, 65, 69; 52/656

[56] References Cited

U.S. PATENT DOCUMENTS

| | | | |
|---|---|---|---|
| 1,246,947 | 11/1917 | Schott | 220/72 |
| 1,769,831 | 7/1930 | Gramm | 220/71 |
| 2,464,343 | 3/1949 | Praeger et al. | 217/69 X |
| 3,044,656 | 7/1962 | Combs et al. | 220/1.5 X |
| 3,353,854 | 11/1967 | Hansen | 52/656 |
| 3,456,829 | 7/1969 | Glassmeyer | 220/1.5 |
| 3,561,633 | 2/1971 | Morrison | 220/1.5 |
| 3,877,138 | 4/1975 | Suchowski | 52/656 |
| 3,955,702 | 5/1976 | Lundy | 220/4 F |
| 3,966,285 | 6/1976 | Porch et al. | 220/4 F X |
| 4,002,261 | 1/1977 | Litchfield | 220/4 F X |

*Primary Examiner*—Allan N. Shoap
*Assistant Examiner*—Robert Petrik
*Attorney, Agent, or Firm*—Bachman and LaPointe

[57] ABSTRACT

A container for transporting goods in the form of packages, bundles or the like having a floor, walls, roof and at least one door which can be locked, is improved such that it can be stored without problem, is spaced-saving when transported empty and light in weight, and allows individual parts to be readily replaced, while at the same time being economical to manufacture.

The container has its floor and roof joined at a distance from each other by vertical corner posts to which stable, rigid sidewalls are also attached such that the corner posts are releasably joined to the floor and roof of the container by cube-like corner pieces. Instead of or in addition to the foregoing design, at least one of the walls feature at least one deep-drawn metal sheet or panel in which stiffening areas are provided, delimited by a peripheral region in the sheet and/or ribs extending from the edge regions.

10 Claims, 9 Drawing Figures

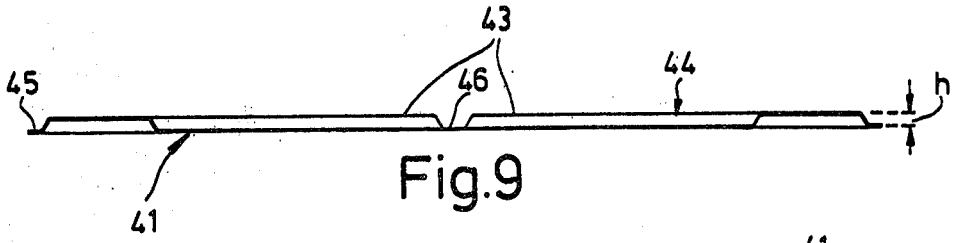
Fig.9
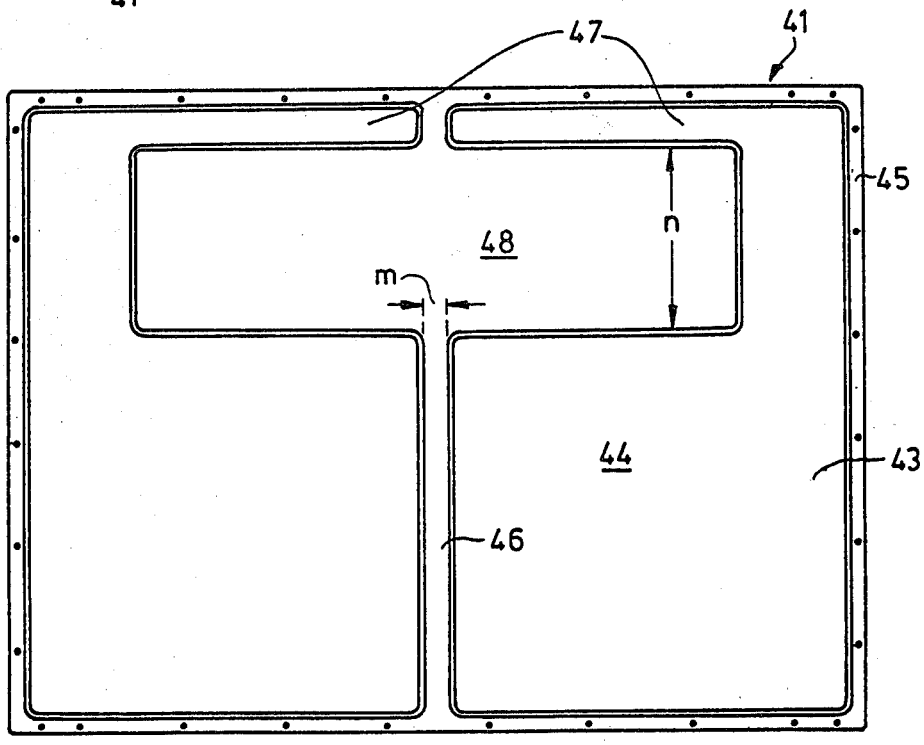
Fig.8
Fig.7
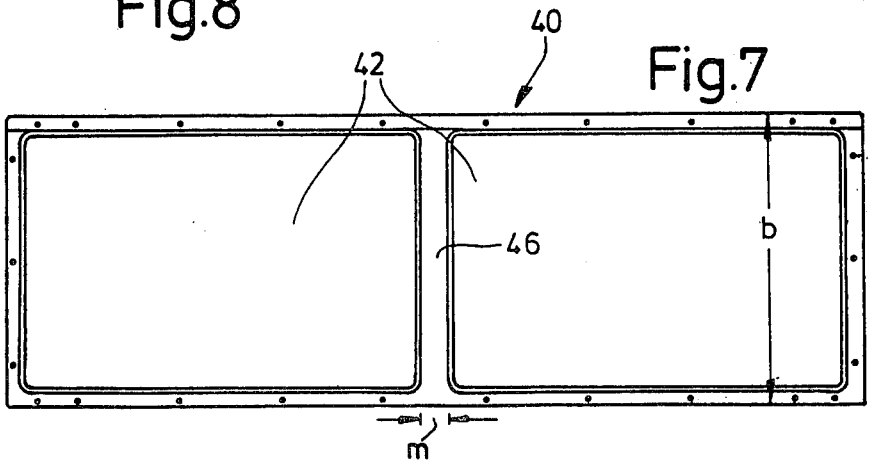

CONTAINER FOR FREIGHT TRANSPORT

BACKGROUND OF THE INVENTION

The present invention relates to a container for transporting freight in the form of bundles, packages or the like having a floor, walls, roof and at least one door which can be locked.

Such containers are already well known for transporting goods by land, sea or air. They are sold as complete containers, which has the disadvantage that the known containers take up a great deal of space when transported empty; it also means there are difficulties when damaged parts have to be replaced.

In view of the above, it is an object of the present invention to develop a container of the kind described at the start but which presents no storage problems, allows space to be saved when transported empty and allows individual parts to be easily changed when damaged. Furthermore, the container of the present invention is economical to manufacture and, especially with regard to air-freight transport is light in weight.

SUMMARY OF THE INVENTION

The foregoing objects are achieved by way of the present invention wherein the floor and roof of the container are joined at a distance from each other by vertical corner posts, and rigid, stable sidewalls are attached to the corner posts.

The corner posts are releasably attached to the roof and floor of the container by block-shaped corner pieces. As an additional measure, which however has also proved to be an independent solution in itself, it has been found useful to design at least one of the walls with at least one deep-drawn metal sheet or panel which features stabilizing areas delimited by a surrounding edge of the metal sheet and/or ribs extending out from this said edge. In this way it is possible to employ for the walls of the container very thin (e.g. 0.6 mm thick) light metal sheet, without requiring the well known, expensive and space-consuming transverse struts.

It is also within the scope of the present invention to manufacture a container wall out of at least two such panels, and viz., a lower base panel of relatively small height and a higher, upper wall panel. The base panel on that wall is often damaged by kicking or other knocks. Now, thanks to the concept according to the present invention, it is possible to make the more heavily worn lower part out of thicker sheet (e.g. 1.5 mm) and to replace that part alone when it is damaged.

The necessary stability required of the very thin metal sheeting for these panels is, as already indicated, achieved by deep-drawing to provide permanent ribs and edges, whereupon it has been found advantageous with larger panels to separate these ribbed areas by a central longitudinal rib and to provide these areas with other ribs which are of greater width than and extend out from the central rib, and such that the longitudinal rib forms a T with the broader ribs. These broader ribs provide a surface which is recessed from the rest of the container surface and is therefore somewhat protected allowing it to be used e.g. for marking identification, destination or the like.

According to another feature of the present invention the distance of the outer surface region of the ribbed area to the base of the ribs or surrounding edge, and therefore the depth produced by deep-drawing, is approximately 15 to 25 mm.

The deep-drawn panels according to the present invention are, when compared with the rivetted container walls with reinforcing struts, both lighter and less expensive.

It is also within the scope of the present invention for the floor and/or roof of the container to be surrounded by a frame of extruded sections, the corners of which floor and/or roof are formed by these corner pieces. The frame sections are, according to the invention, permanently joined to the floor or roof of the container or a part thereof, the corner of the roof or floor being removed beforehand. The corner piece features, on each of two vertical surfaces which are perpendicular to each other, at least one projecting flange which can be inserted into the interior of the one or the other frame sections. Furthermore, another surface, perpendicular to the two orthogonal surfaces mentioned, is provided with stub-like projections for the corner post section which is pushed onto these and bolted on to the corner piece.

Usefully the flanges in the two, perpendicular, neighboring frame sections are also releasably attached, for example by means of bolts which according to the invention pass through that flange viz.,—with respect to the frame—the inner wall of the frame sections, and are bolted into an angular corner piece which rests against the innermost side of that inner wall of the section. This angular corner piece forms therefore a support and one grip for a clamping joint, the other grip being provided by a flange on the cube-like corner piece.

According to another feature of the present invention the interior of the hollow section is subdivided by inner walls into chambers into which the individual stub-like projections of the corner piece project; consequently there is no longer any need for special adjustment of the section on the corner piece.

The hollow sections of the container feature, with respect to their longitudinal axis, off center threaded holes into which the bolts which pass through the opening in the corner piece are screwed. For reasons of stability it has been shown to be particularly advantageous to provide the threaded hole at the meeting point of at least one pair of inner walls.

BRIEF DESCRIPTION OF THE DRAWINGS

Further advantages, features and details of the present invention are revealed in the following description of preferred exemplified embodiments of the invention with the help of the drawings wherein

FIG. 7: Plan view of an aluminum panel.

FIG. 8: Plan view of another aluminum panel.

FIG. 9: End view of the aluminum panel shown in FIG. 8.

DETAILED DESCRIPTION

Figure 1:
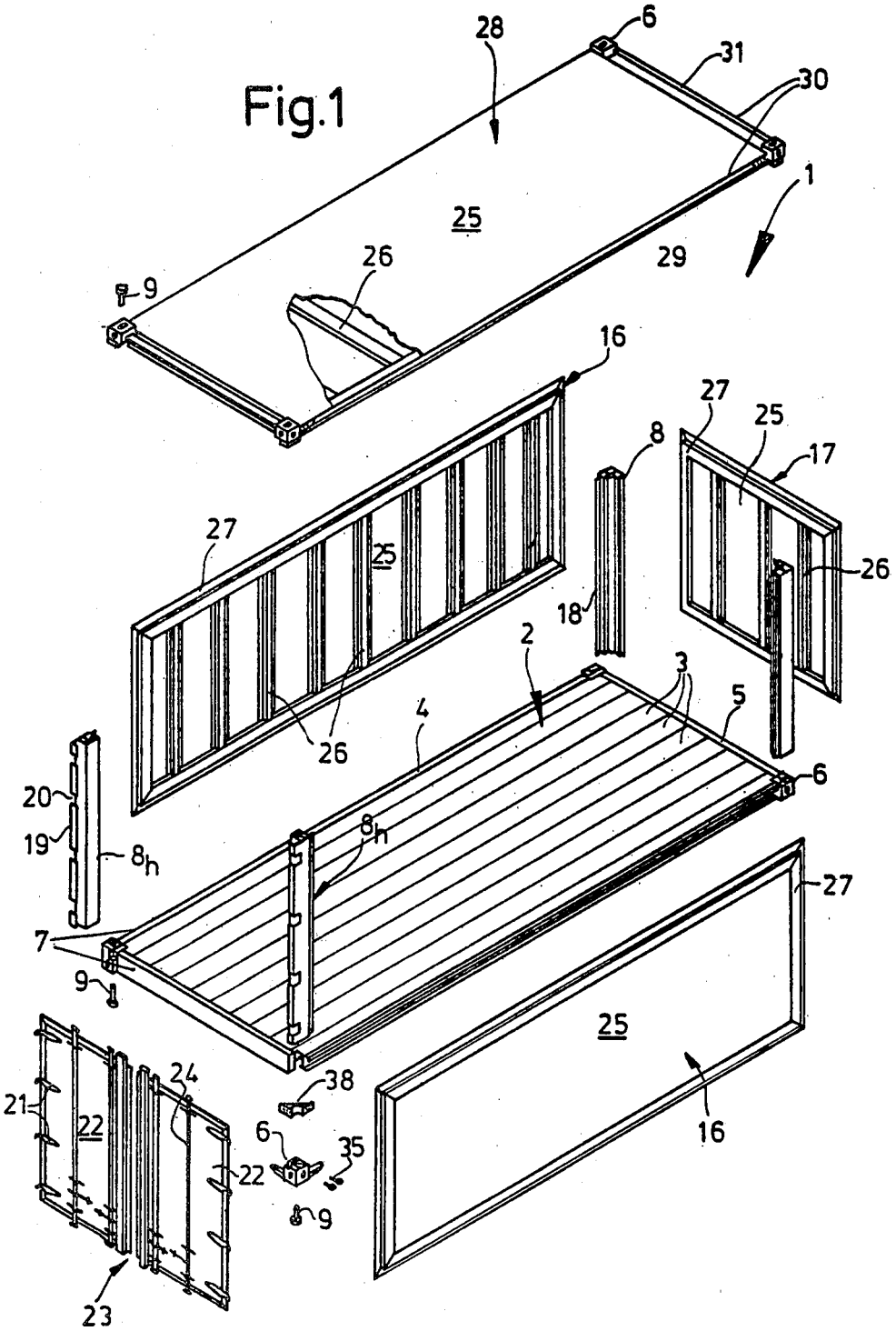
FIG. 1: An exploded perspective view of a container.

A container 1 for transporting all kinds of freight features a floor panel 2 made of extruded aluminum sections 3 which are attached to extruded frame sections 4,5. These are joined by means of cube-like corner pieces 6 to a base frame 7 surrounding the aluminum sections 3.

Hollow sections 8 in the form of vertical posts are joined by means of bolts 9 to the corner pieces 6 perpendicular to the base frame 7. These bolts 9 pass through openings 10 in the corner pieces 6 and engage in threaded holes 11 in the hollow sections 8. The threaded holes 11 run parallel to the axis A of the hollow sections 8 and lie at the meeting point of reinforcing channels 12 in the section 8. These channels 12 form chambers 13 which accommodate the projecting, shaped steps 14 on the corner piece 6.

Longitudinal flanges 18 (FIG. 2) projecting out from the hollow sections 8 act as connecting pieces for two sidewalls 16 and an endwall 17 running in the direction of the frame sections 4,5. On both of the rear sections $8_h$ of the container 1, spaced a distance i apart, are angular parts 19 in the spaces 20 between which are mounted hinged pieces 21 of the wings 22 of an end door 23. For the sake of clarity the counterparts to the hinge pieces 21 and the counterpart for the locking rod 24 on the door 23 are omitted in the drawing.

The sidewalls 16 and the end wall 17 are made of aluminum sheet panels 25 on a frame 27 reinforced with cross ribs 26.

Bolted on to the upper ends of the hollow sections 8 is a roof element 28 made of an aluminum sheet 25, longitudinal sections 29 joined by cross ribs 26 and cross sections 31 joined to a roof frame 30 by corner pieces 6.

Figure 2:
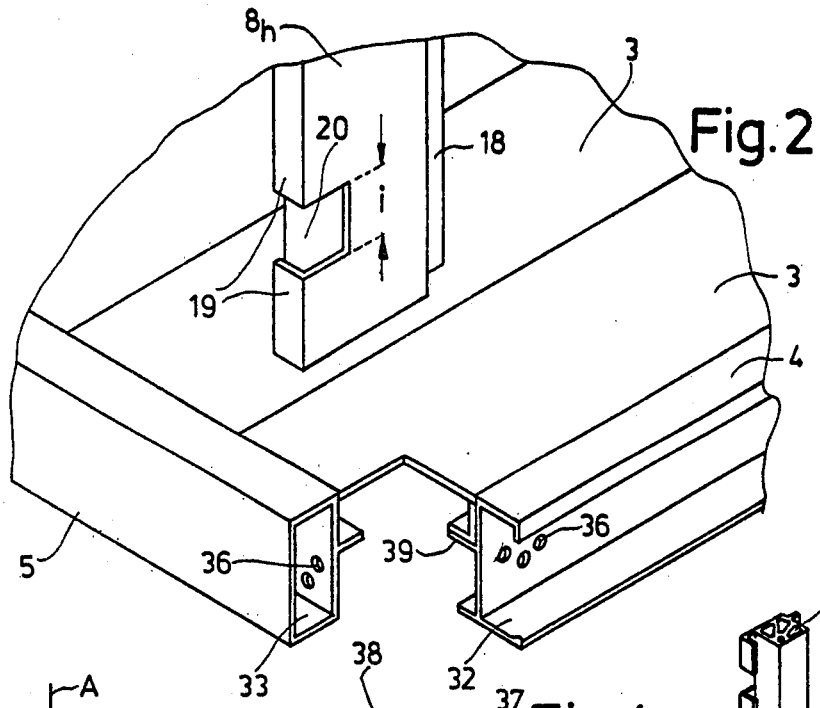
FIG. 2: An enlarged view of part of FIG. 1 showing a free corner into which a corner piece can be inserted.
Figure 4:
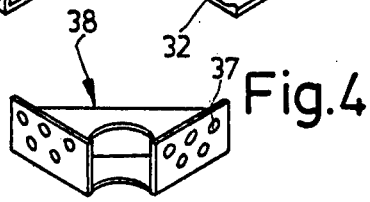
FIG. 4: A perspective view of a further detail in FIG. 1.
Figure 5:
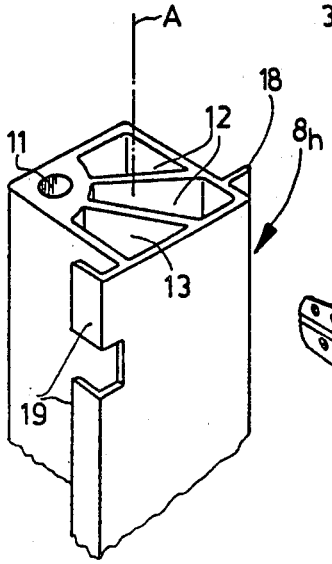
FIG. 5: An enlarged view of a hollow section which is shown in FIG. 1 and which can be set onto the corner piece shown in FIG. 3.
Figure 3:
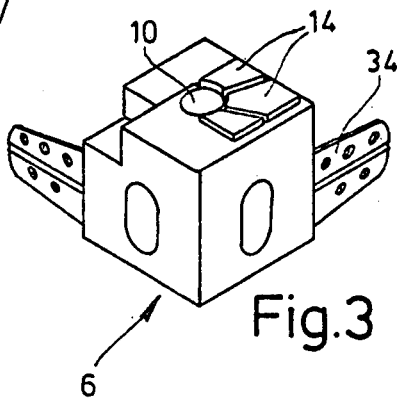
FIG. 3: A perspective view of a corner piece.
Figure 6:
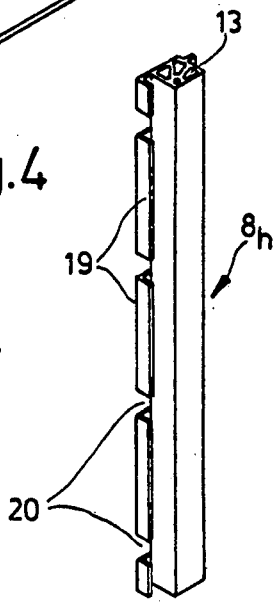
FIG. 6: A perspective view of another hollow section shown on a smaller scale than in FIG. 5.

As can be seen particularly well in FIGS. 2–4, the frame sections 4,5 in the base frame 7, and likewise the frame sections 29,31 of the roof frame 30, are in the form of U-sections or as hollow sections so that flanges 34 at the sides of the corner piece 6 can be inserted in the corresponding spaces 32 or 33 and secured there by bolts 35 (FIG. 1) which pass through the holes 36 in the sections 4,5,29,31 of the frames and engage in the threaded holes 37 in an angular corner piece 38. The corner piece 38 is positioned on a flange 39 projecting out from the section wall and adjusted into place without difficulty.

In another exemplified embodiment of an end wall its frame 27 which is free of cross ribs 26 is subdivided into the aluminum panels 40,41 (FIGS. 7–9) which are stiffened by the provision of shaped areas 42,43. These shaped areas 42 or 43 in the aluminum panels 40,41 of sheet thickness for example of 0.9 mm are produced by deep-drawing; the difference in height h of their surface 44 from that of the surrounding frame 45 and an inner rib 46 is about 25 mm.

A stiffening area 48 of breadth n, for example 300 mm, extends on both sides of rib 46 of breadth m, for example 50 mm, near the upper edge region 47 to form a T-shaped area 48 together with rib 46.

The aluminum sheet 40 used as base panel is of breadth b of about 480 mm and is bolted securely to the bottom of the end wall; the other aluminum panel 41 is attached above the base panel 40 to form an upper panel, as in FIGS. 8, 9. By this subdivision of the endwall into two panels it is possible to change the base region of the wall, if damaged by the frequent kicks or other knocks it receives, and/or to make this lower panel out of a thicker—for example 1.2 mm thick—sheet than that used for the upper panel 41.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A container for transporting goods, said container having a floor, a plurality of sidewalls, a roof and at least one door, the improvement which comprises: a plurality of posts extending between said floor and said roof, said plurality of posts each being provided with means for attaching said plurality of sidewalls to said plurality of posts; attachment means associated with said plurality of posts and said floor and said roof for releasably securing said plurality of posts to said floor and said roof wherein said floor and said roof are surrounded by a profiled frame, the corners of which are formed by said attachment means, said attachment means comprises a cube-shaped piece having on each of two vertical surfaces which are perpendicular to each other at least one tongue-like projecting flange and, on another surface perpendicular to said two vertical surfaces, step-like projections; and wherein said plurality of posts each comprises a hollow section adapted to mate with said step-like projections on said attachment means wherein the interior of each hollow section is subdivided by walls into a plurality of chambers, the cross section of each chamber corresponding to the cross section of a step-like projection on said attachment means so as to clamp said hollow section to said attachment means.

2. A container according to claim 1 wherein said at least one of said plurality of sidewalls comprises at least one metal plane provided with a plurality of stiffening areas.

3. A container according to claim 2 wherein said at least one sidewall comprises on its lower part at least one base panel of relatively small height and on its upper part at least one upper metal panel.

4. A container according to claim 3 wherein said panels are made of aluminum sheet 0.5–2 mm thick, with said base panel preferably being about 1.5 mm thick and about double the thickness of the adjoining upper panel.

5. A container according to claim 3 wherein said plurality of stiffening areas are subdivided by a central rib of breadth (m) and another rib of breadth (n) which extends out from and is broader than said central rib such that both ribs together form a T-shape.

6. A container according to claim 5 wherein the distance (h) of the surface of said stiffening areas lies a distance (h) of about 15–25 mm from the base of the ribs.

7. A container according to claim 11 wherein said flanges on said attachment means are received in spaces in said profiled frame.

8. A container according to claim 7 wherein said attachment means is bolted to an angular corner piece provided behind said profiled frame as a support, with a wall of said frame in between said attachment means and said corner piece.

9. A container according to claim 8 wherein each of said hollow sections includes at least one threaded hole for receiving a bolt passing through said attachment means, said threaded hole being situated preferably off center at the meeting place of at least two of the walls in said hollow section.

10. A container according to claim 9 wherein said walls of said hollow section run fan-like from a common meeting point on the outer wall of said section.

* * * * *